US006553605B2

(12) United States Patent
Kim

(10) Patent No.: US 6,553,605 B2
(45) Date of Patent: Apr. 29, 2003

(54) ROLLER CAGE FRAME

(76) Inventor: Song Kim, 2312 Via Pinale, Palos Verdes Estates, CA (US) 90274

( * ) Notice: Subject to any disclaimer, the term of this patent is extended or adjusted under 35 U.S.C. 154(b) by 0 days.

(21) Appl. No.: 09/893,210

(22) Filed: Jun. 26, 2001

(65) Prior Publication Data

US 2002/0029435 A1 Mar. 14, 2002

Related U.S. Application Data

(63) Continuation of application No. 09/116,228, filed on Jul. 16, 1998, now abandoned.

(51) Int. Cl.[7] ..... B05C 17/02
(52) U.S. Cl. ..... 15/230.11; 492/13; 492/19
(58) Field of Search ..... 15/230.11, 244.1, 15/104.002; 492/13, 14, 15, 16, 19

(56) References Cited

U.S. PATENT DOCUMENTS

| | | | | |
|---|---|---|---|---|
| 2,563,049 | A | * | 8/1951 | Liebelt |
| 2,794,202 | A | * | 6/1957 | Schueler |
| 3,119,137 | A | * | 1/1964 | Schueler |
| 3,228,087 | A | * | 1/1966 | Stoddart |
| 3,774,278 | A | * | 11/1973 | Ashton |
| 5,584,092 | A | * | 12/1996 | Polzin |
| 5,623,740 | A | * | 4/1997 | Burns |
| 5,979,009 | A | * | 11/1999 | Polzin et al. |

* cited by examiner

*Primary Examiner*—Randall E. Chin
(74) *Attorney, Agent, or Firm*—Fulbright & Jaworski L.L.P.

(57) ABSTRACT

An improved paint roller in which a roller cage formed of a plurality of elongated rods are mounted between end members, selected rod members being formed with interruptions along their lengths to prevent a paint cover from "walking off" the roller cage.

3 Claims, 4 Drawing Sheets

ROLLER CAGE FRAME

This application is a continuation of U.S. Ser. No. 09/116,228, file Jul. 16, 1998, and now abandoned.

BACKGROUND OF INVENTION

1. Field of the Invention

The present invention provides an improved roller for specialty paint finishes, the roller, in one embodiment utilizing a natural sponge material secured to the roller handle assembly and, in a second embodiment, an improved roller handle assembly wherein the assembly frame ribs are notched to secure the roller tube/sponge material assembly to the roller.

2. Description of the Prior Art

U.S. Pat. No. 5,206,979 to Carpbell discloses an improved roller for specialty paint finishes wherein a generally cylindrically shaped rag component is twisted around the roller handle assembly tube and tucked into the axial cavity of the roller tube, the rag component being twisted with respect to the roller tube. The apparent improvement of this patent is the use of a rag component so that it is formed as a component for a roller handle assembly device, widely used by the public, as compared to using separate rag material applied by hand to the top paint coat which overlies a base coat.

The prior art described in the '979 paint sets forth the problems using hand tools which are hand manipulated to form a specialty finish. In particular, gloves are required and a mess typically results. The twisted rag component covering the roller tube applies a specialty finish using either the positive or negative application method; however, the use of man made roller has drawbacks in that the roller position is difficult to control as is the paint release.

United States patents developed as a result of a patentability search includes U.S. Pat. No. 2,434,462 to Kempthone which discloses a roller for finishing surfaces of sprayed fibrous material; U.S. Pat. No. 2,467,010 to Coley which discloses a conventional roller type applicator having the roller surface modified with a thickened paint to produce a textured pattern on a surface; U.S. Pat. No. 5,577,291 to Myers et al which discloses a paint roller having cartridges positioned around the roller, decorative flaps comprising a part of the cartridge to form patterns on a surface; and U.S. Pat. No. 4,930,179 to Wright et al discloses a decorating paint roller having flexible flaps on the roller surface.

Although the '291 and '979 patents refer to sponges used to apply a specialty finish to an interior wall, for example, the prior art does not suggest that a natural sponge can be secured to a roller handle assembly to form the specialty finish.

Another problem in the prior art is that the rollers tend to separate from the underlying metal frame over a number of paint strokes, the conventional roller frame comprising a series of metal rib members having a smooth surface.

What is therefore desired is to provide a roller which overcomes the above disadvantages of using a man made material to apply the specialty finish and a roller that more securely holds the roller tube to the underlying frame member.

SUMMARY OF THE INVENTION

The present invention provides a improved specialty paint finish roller comprising a conventional roller handle assembly having an axle portion, a roller tube and a naturally occurring sponge material secured around the roller tube. The roller tube is fabricated by slicing natural sponge in a manner to form essentially flat sponge pieces. One of the sponge pieces is then placed over a surface of a base material having an adhesive applied thereto, the sponge material thereby adhering to the base material. The sponge/base material is then cut lengthwise into strips.

An adhesive is applied to an elongated roller member and the strip of sponge/base material is then wound about the surface of the roller member, the adhesive then being allowed to dry. The elongated tube member is then cut to predetermined sizes, the resulting roller tube being joined to the roller handle assembly in a conventional manner.

Using a natural sponge as the paint applicator produces a natural design, each roller being unique such that a unique design is applied to an interior wall. In addition, the natural sponge material holds a relatively large amount of paint, the paint being released easily under pressure.

In a second embodiment of the invention, the conventional roller cage frame is modified by forming notches in selected elongated frame rod members whereby the roller cover positioned thereover is prevented from "walking-off" the frame because of the added resistance provided by the notches.

DESCRIPTION OF THE DRAWING

For a better understanding of the invention as well as other objects and further features thereof, reference is made to the following description with is to be read in conjunction with the drawing wherein.

DESCRIPTION OF THE INVENTION

Figure 1:
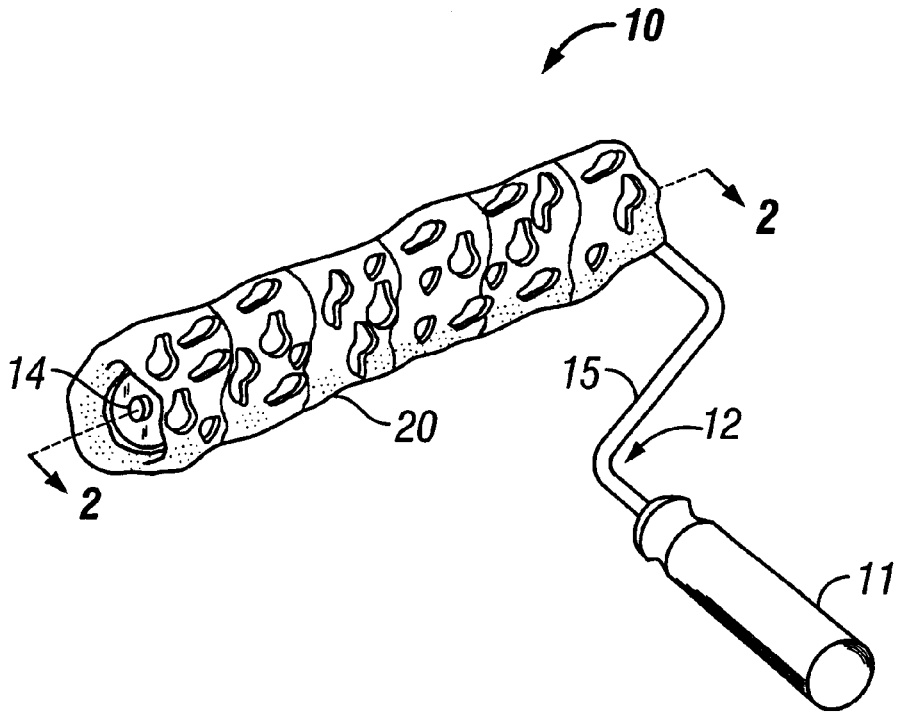
FIG. 1 is a perspective view of the specialty paint finish roller of the present invention.
Figure 2:
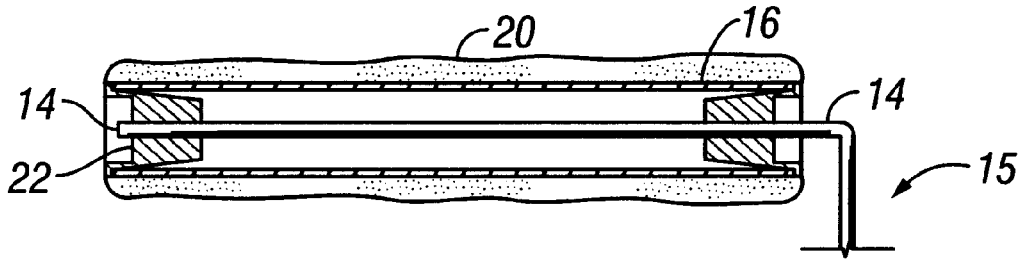
FIG. 2 is a sectional view along line 2–2 of FIG. 1.

Referring now to FIGS. 1 and 2, the specialty paint finish roller 10 of the present invention is illustrated. Roller 10 for the most part is conventional and comprises roller handle assembly 12 having handle 11, axle portion 14 extending within the cavity formed in roller tube 16 along the longitudinal axis thereof and a connecting member 15 for connecting axle 14 transversely with respect to handle 11. A bushing 18 rotatably interfaces with axle 14 of roller handle assembly 12 and a cap member 19 is provided at the other end of roller tube 16 as illustrated. In accordance with the teachings of the present invention, a roller cover member 20 comprising a natural sponge material, secured to the underlying roller tube 16, is utilized to apply paint in the positive method (the positive and negative method of forming designs are set forth in the '979 patent) to the interior wall base coat to form a unique design thereon. The advantages of using a paint roller instead of direct hand manipulation tools has been described in the aforementioned '979 patent. The use of natural sponge as the roller cover material provides advantages not provided by the rag component disclosed in the '979 patent. In particular, natural sponge holds relatively large amounts of paint, the paint releasing easily under pressure.

FIGS. 3 through 8 illustrate the steps for fabricating the roller cover 20 in accordance with the teachings of the present invention.

Figure 3:
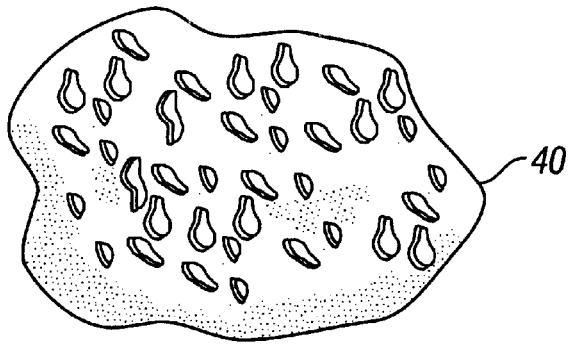
FIGS. 3–8 illustrate the steps in providing the roller tube with attached cover in accordance with the teachings of the present invention.
Figure 4:
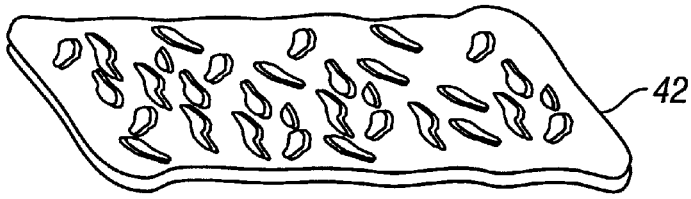
Figure 5:
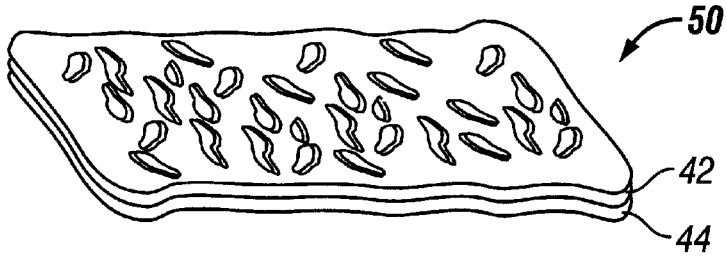
Figure 6:
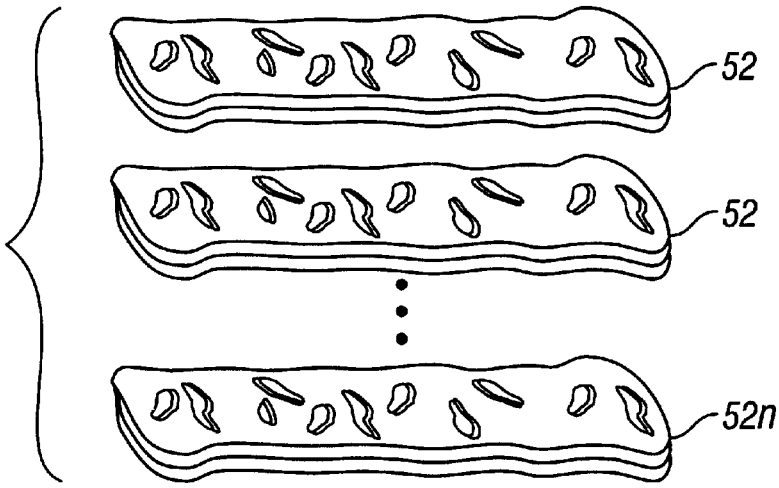

FIG. 3 shows, in simplified form, a natural sponge 40. As is well known, natural sponge in various shapes and sizes is commercially available from many sources. The natural sponge 40 is then cut by a band saw, for example, to form a plurality of strips of a predetermined thickness (FIG. 4 shows a single strip 42). A base material, such as cotton, 44 is first placed on a table and the sponge strip 42 is then secured to the base material via an adhesive material to form the assembly 50 shown in FIG. 5. Other materials can be used as the backing material, such as fabric materials other than cotton, plastic sheets and rubber, natural or synthetic. Assembly 50 is then cut into strips 52 . . . 52*n* of a predetermined length as shown in FIG. 6.

Figure 7:
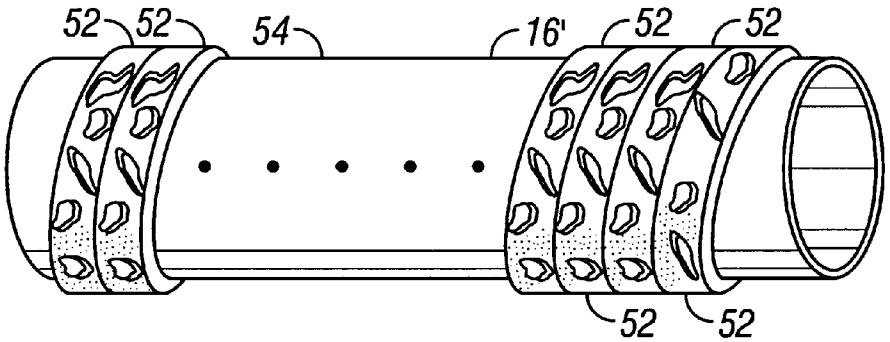

An elongated roller tube 16', shown in FIG. 7, has a layer of adhesive first applied to the outer tube surface 54. A strip is then diagonally wound around outer surface 54. It should be noted that other techniques can be used to apply the sponge to the roller tube in order to fabricate the roller covers.

Figure 8:
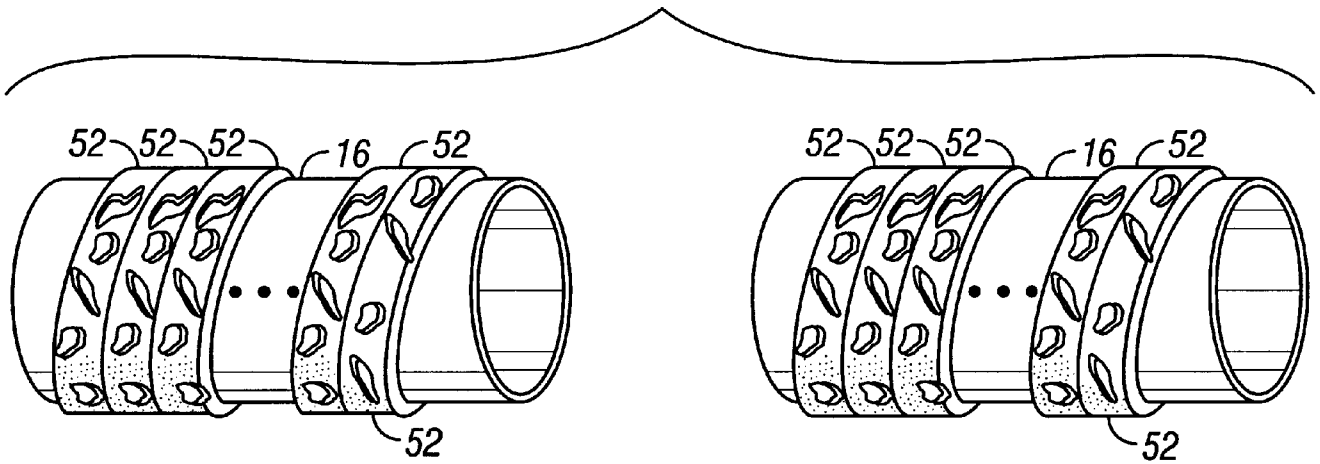

The final step is illustrated in FIG. 8 wherein elongated roller tube 16' is cut to predetermined lengths to form the roller tube/roller cover 20 described in FIGS. 1 and 2.

Figure 9:
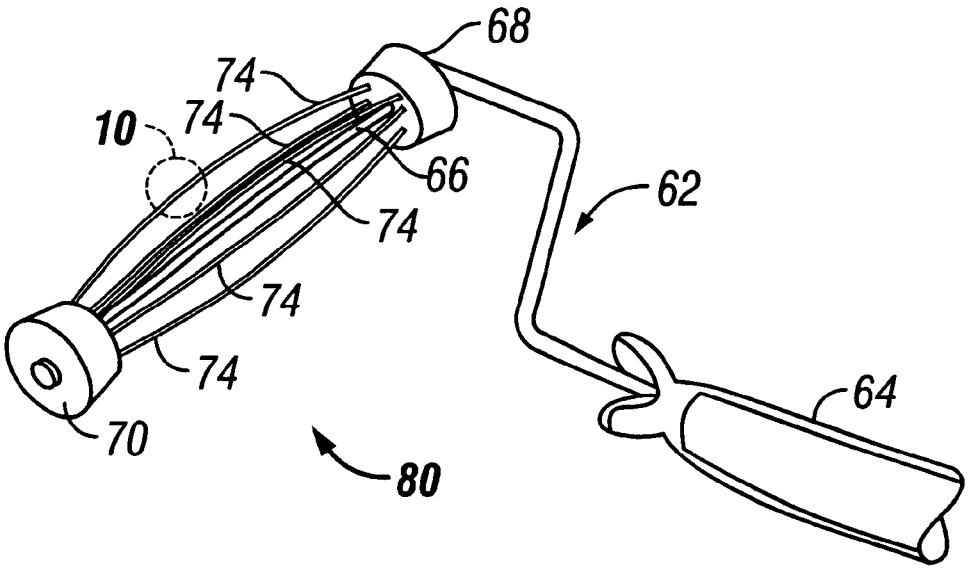
FIG. 9 illustrate an improved roller cage frame in accordance with the teachings of the present invention.
Figure 10:
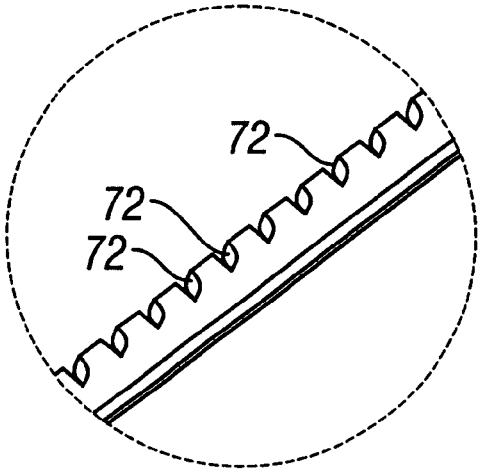
FIG. 10 is an enlargement of region "A" on FIG. 9.

FIG. 9 illustrates a conventional roller handle assembly 62 having handle 64, axle 66 and bushings 68 and 70. In accordance with a further teaching of the present invention, interruptions, such as notches 72, are formed along the length of elongated rods 74 as illustrated in detail A. Although five elongated rods 74 are illustrated, either more or less can be utilized. A conventional roller tube (not shown), is positioned over the cage frame 80. Notches 72 add resistance between the inside diameter of the roller tube and the elongated rods 74 and prevents the roller tube from slipping or disengaging, from the cage frame 80. It should be noted that although it is preferred to form notches in each of the elongated rods 74, the notches can also be formed in fewer than the five elongated rods illustrated. A specific notch design is not required for the successful operation of the present invention. For example, the notches can be V-shaped, U-shaped, etc. of a predetermined width, depth, etc. In addition, the spacing between notches along the elongated rods can vary, the particular parameters being determined by customer requirements. It should be noted that other means can be utilized to add resistance, such as creating small protrusions, or bumps, along the length of the elongated rods by conventional fabrication techniques. It should be noted that other roller handle assemblies can use the concept of added resistance to prevent walk-off, such as the assembly shown in FIG. 1. Further, the concepts disclosed hereinabove can be used in applications other than painting.

The present invention thus provides a roller cover that provides a technique for painting unique designs on interior walls, each cover proving a unique design, and a cage frame that minimizes the possibility of the roller cover slipping off.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A roller cage frame for a roller cover having two end members, said frame comprising a plurality of elongated members spaced from each other and extending between said two end members, the improvement comprising notches formed along a substantially smooth length of at least one of said elongated rod members whereby a roller cover positioned thereover is prevented from "walking off" the frame because of the resistance provided by said notches.

2. The roller cage of claim 1 wherein said notches are formed along the length of each of said plurality of elongated rod members.

3. The roller cage frame of claim 1 wherein said notices are spaced apart a substantially equal distance along each of said notched elongated rod members.

* * * * *